US006893874B2

(12) United States Patent
Stark et al.

(10) Patent No.: US 6,893,874 B2
(45) Date of Patent: May 17, 2005

(54) METHOD FOR STORING AND TRANSPORTING CRUDE OIL

(75) Inventors: Joseph L. Stark, Richmond, TX (US); C. Mitch Means, Richmond, TX (US)

(73) Assignee: Baker Hughes Incorporated, Houston, TX (US)

( * ) Notice: Subject to any disclaimer, the term of this patent is extended or adjusted under 35 U.S.C. 154(b) by 344 days.

(21) Appl. No.: 09/957,565

(22) Filed: Sep. 20, 2001

(65) Prior Publication Data

US 2002/0062860 A1 May 30, 2002

Related U.S. Application Data

(63) Continuation-in-part of application No. 09/690,164, filed on Oct. 17, 2000, now Pat. No. 6,467,340.

(51) Int. Cl.[7] ..... G01N 31/00

(52) U.S. Cl. ..... 436/55; 436/60; 436/139; 73/152.18; 73/152.24; 73/61.41

(58) Field of Search ..... 73/152.18, 152.24, 73/61.41, 61.34, 61.59; 436/60, 139, 55

(56) References Cited

U.S. PATENT DOCUMENTS

| | | | | |
|---|---|---|---|---|
| 3,211,225 A | | 10/1965 | Thiessen et al. | 166/75 |
| 3,710,867 A | | 1/1973 | Bansbach | 166/244 C |
| 4,064,936 A | | 12/1977 | McClure | 166/90.1 |
| 4,160,734 A | | 7/1979 | Taylor et al. | 210/96.1 |
| 4,284,143 A | | 8/1981 | Scherrer et al. | 166/350 |
| 4,354,553 A | | 10/1982 | Hensley | 166/250.05 |
| 4,375,833 A | | 3/1983 | Meadows | 166/64 |
| 4,408,143 A | | 10/1983 | Inohara et al. | 315/366 |
| 4,436,148 A | | 3/1984 | Maxwell | 166/53 |
| 4,566,536 A | | 1/1986 | Holmes | 166/250.15 |
| 4,580,952 A | | 4/1986 | Eberle | 417/383 |
| 4,582,131 A | | 4/1986 | Plummer | 166/68 |
| 4,635,723 A | | 1/1987 | Spivey | 166/250 |
| 4,665,981 A | | 5/1987 | Hayatdavoudi | 166/250 |
| 4,683,929 A | | 8/1987 | Wyman | 152/313 |
| 4,721,158 A | | 1/1988 | Merritt, Jr. et al. | 166/250 |
| 4,747,451 A | | 5/1988 | Adams, Jr. et al. | 340/854.4 |
| 4,830,112 A | | 5/1989 | Erickson | 166/304 |
| 4,832,121 A | | 5/1989 | Anderson | 166/250.09 |
| 4,843,247 A | * | 6/1989 | Yamazoe et al. | 250/573 |
| 4,853,337 A | * | 8/1989 | Dickakian | 436/55 |
| 4,907,857 A | | 3/1990 | Giuliani et al. | 385/12 |
| 4,974,929 A | | 12/1990 | Curry | 385/12 |

(Continued)

FOREIGN PATENT DOCUMENTS

| | | |
|---|---|---|
| WO | WO98/50680 | 12/1998 |
| WO | WO98/57030 | 12/1998 |

OTHER PUBLICATIONS

Brost et al., "Optical Methods for Monitoring Treating Chemicals in Oilfield Water Systems", SPE #22781. Oct. 6, 1991, pp. 217–232.

*Primary Examiner*—Jill Warden
*Assistant Examiner*—Sam P. Siefke
(74) *Attorney, Agent, or Firm*—Madan, Mossman & Sriram, P.C.

(57) ABSTRACT

Disclosed is a method for transporting blended crude oils comprising the steps of; (a) admixing a first crude oil with a second, different crude oil to form a crude oil admixture; (b) determining a first value representing the content of unprecipitated asphaltenes in the admixture; (c) holding the admixture for a period of time at standard conditions; (d) determining a second value representing the content of unprecipitated asphaltenes in the admixture; and (e) either: (i) transporting the admixture if the second value is the same as or within a predetermined range of the first value; or (ii) taking remedial action to prevent asphaltene precipitation prior to transporting if the second value is outside a predetermined range from the first value. Also disclosed is a method for estimating the storage stability of stored crude oils and crude oil admixtures.

11 Claims, 9 Drawing Sheets

U.S. PATENT DOCUMENTS

| | | | | |
|---|---|---|---|---|
| 5,059,790 | A | 10/1991 | Klainer | 250/227.21 |
| 5,098,659 | A | 3/1992 | Yim et al. | 422/82.07 |
| 5,115,811 | A | 5/1992 | Hartlaub et al. | 600/342 |
| 5,147,561 | A | 9/1992 | Burge et al. | 210/747 |
| 5,172,717 | A | 12/1992 | Boyle et al. | 137/155 |
| 5,209,301 | A | 5/1993 | Ayres | 166/305.1 |
| 5,307,146 | A | 4/1994 | Porter et al. | 356/320 |
| 5,353,237 | A | 10/1994 | Bass et al. | 364/502 |
| 5,359,681 | A | 10/1994 | Jorgenson et al. | 385/12 |
| 5,413,175 | A | 5/1995 | Edmunds | 166/252 |
| 5,418,614 | A | 5/1995 | Brost et al. | 356/434 |
| 5,517,593 | A | 5/1996 | Nenniger et al. | 392/301 |
| 5,569,838 | A | 10/1996 | Broedel et al. | 73/23.32 |
| 5,570,437 | A | 10/1996 | Kluth et al. | 385/12 |
| 5,590,985 | A | 1/1997 | Mack | 366/20 |
| 5,672,515 | A | 9/1997 | Furlong | 436/133 |
| 5,706,896 | A | 1/1998 | Tubel et al. | 166/313 |
| 5,714,121 | A | 2/1998 | Alderete et al. | 422/82.07 |
| 5,735,346 | A | 4/1998 | Brewer | 166/250.03 |
| 5,747,348 | A | 5/1998 | Jaduszliwer et al. | 436/106 |
| 5,829,520 | A | 11/1998 | Johnson | 166/250.01 |
| 5,872,876 | A | 2/1999 | Kluth et al. | 385/12 |
| 5,937,946 | A | 8/1999 | Streetman | 166/267 |
| 5,992,250 | A | 11/1999 | Kluth et al. | 73/866.5 |
| 6,006,828 | A | 12/1999 | Kluth et al. | 166/156 |
| 6,006,832 | A | 12/1999 | Tubel et al. | 166/250.01 |
| 6,022,748 | A | 2/2000 | Charych et al. | 436/527 |
| 6,026,847 | A | 2/2000 | Reinicke et al. | 137/487.5 |
| 6,125,938 | A | 10/2000 | Garcia-Soule et al. | 166/344 |

* cited by examiner

METHOD FOR STORING AND TRANSPORTING CRUDE OIL

RELATED APPLICATIONS

This application is a continuation-in-part of U.S. patent application Ser. No. 09/690,164 filed on Oct. 17, 2000, now U.S. Pat. No. 6,467,340.

BACKGROUND OF THE INVENTION

1. Field of the Invention

This invention relates to a method useful for storing crude oil and transporting crude oil. This invention particularly relates to a method for storing crude oil and transporting crude oil in tanks and through pipes and pipelines.

2. Background of the Art

Many formation fluids such as petroleum fluids contain a large number of components with a very complex composition. Some of the components present in production fluid, for example wax and asphaltenes, are normally solids under ambient conditions, particularly at ambient temperatures and pressures. Asphaltenes are typically dark brown to black-colored amorphous solids with complex structures and relatively high molecular weight. In addition to carbon and hydrogen, asphaltenes also can contain nitrogen, oxygen and sulfur species. Typical asphaltenes are known to have some solubilities in the production fluid itself or in certain solvents like carbon disulfide, but are usually insoluble in solvents like light naphthas.

When the formation fluid from a subsurface formation comes into contact with a pipe, a valve or other production equipment of a wellbore or when there is a decrease in temperature, pressure, or change of other conditions, asphaltenes may precipitate or separate out of a well stream or the formation fluid while flowing into and through the wellbore to the wellhead. While any asphaltene separation or precipitation is undesirable in and by itself, it is much worse to allow the asphaltene precipitants to accumulate by sticking to the equipment in the wellbore. Any asphaltene precipitants sticking to the wellbore surfaces may narrow pipes; and clog wellbore perforations, various flow valves, and other wellsite and downhole equipment.

For purposes of the present invention, the term "crude oil" means the petroleum fluids produced from an oil well. Typically, the crude oil produced from an oil well is treated to remove excess water and inorganic solids such as salt and then collected and stored for shipment to a refinery. Often, the crude oil from several fields can be accumulated at a central point for shipping through a pipeline.

Precipitations and accumulations of asphaltenes in a pipeline for transferring crude oil could result in loss of oil flow and/or equipment failure. Crude oil storage facilities could have maintenance or capacity problems if asphaltene precipitations occur during shipping of crude oil. Precipitation of asphaltene during shipping is clearly just as undesirable as during production. As a result of these potential problems, many chemicals, also referred to herein as "additives", including solvents, are available to prevent or control the precipitation of asphaltenes. Often, by the time a crude oil reaches a shipping center, it may contain at least some of these additives.

It would be desirable in the art of shipping crude oil by pumping the crude oil through pipelines to minimize the precipitation of asphaltenes during shipping. It would also be desirable if the more than one crude oil could be blended and then so shipped while still minimizing the precipitation of asphaltenes. It would be even more desirable if these objectives could be achieved while saving chemical and energy costs.

SUMMARY OF THE INVENTION

In one aspect, the present invention is a method for transporting blended crude oils comprising the steps of; (a) admixing a first crude oil with a second, different crude oil to form a crude oil admixture; (b) determining a first value representing the content of unprecipitated asphaltenes in the admixture; (c) holding the admixture for a period of time at standard conditions; (d) determining a second value representing the content of unprecipitated asphaltenes in the admixture; and (e) either: (i) transporting the admixture if the second value is the same as or within a predetermined range of the first value; or (ii) taking remedial action to prevent asphaltene precipitation prior to transporting the admixture if the second value is outside a predetermined range from the first value.

In another aspect, the present invention is a method for determining the storage stability of crude oil or crude oil admixtures comprising the steps of: (a) determining a first value representing the content of unprecipitated asphaltenes in the crude oil or crude oil admixture; (b) holding the crude oil or crude oil admixture for a period of time at standard conditions; (c) determining a second value representing the content of unprecipitated asphaltenes in the crude oil or crude oil admixture; and (d) estimating the storage stability of the crude oil or crude oil admixture, the estimation being based upon the difference, if any between the first value and second value.

BRIEF DESCRIPTION OF THE DRAWINGS

For a detailed understanding and better appreciation of the present invention, reference should be made to the following detailed description of the invention and the preferred embodiments, taken in conjunction with the accompanying drawings.

DETAILED DESCRIPTION OF THE PREFERRED EMBODIMENT

Figure 1:
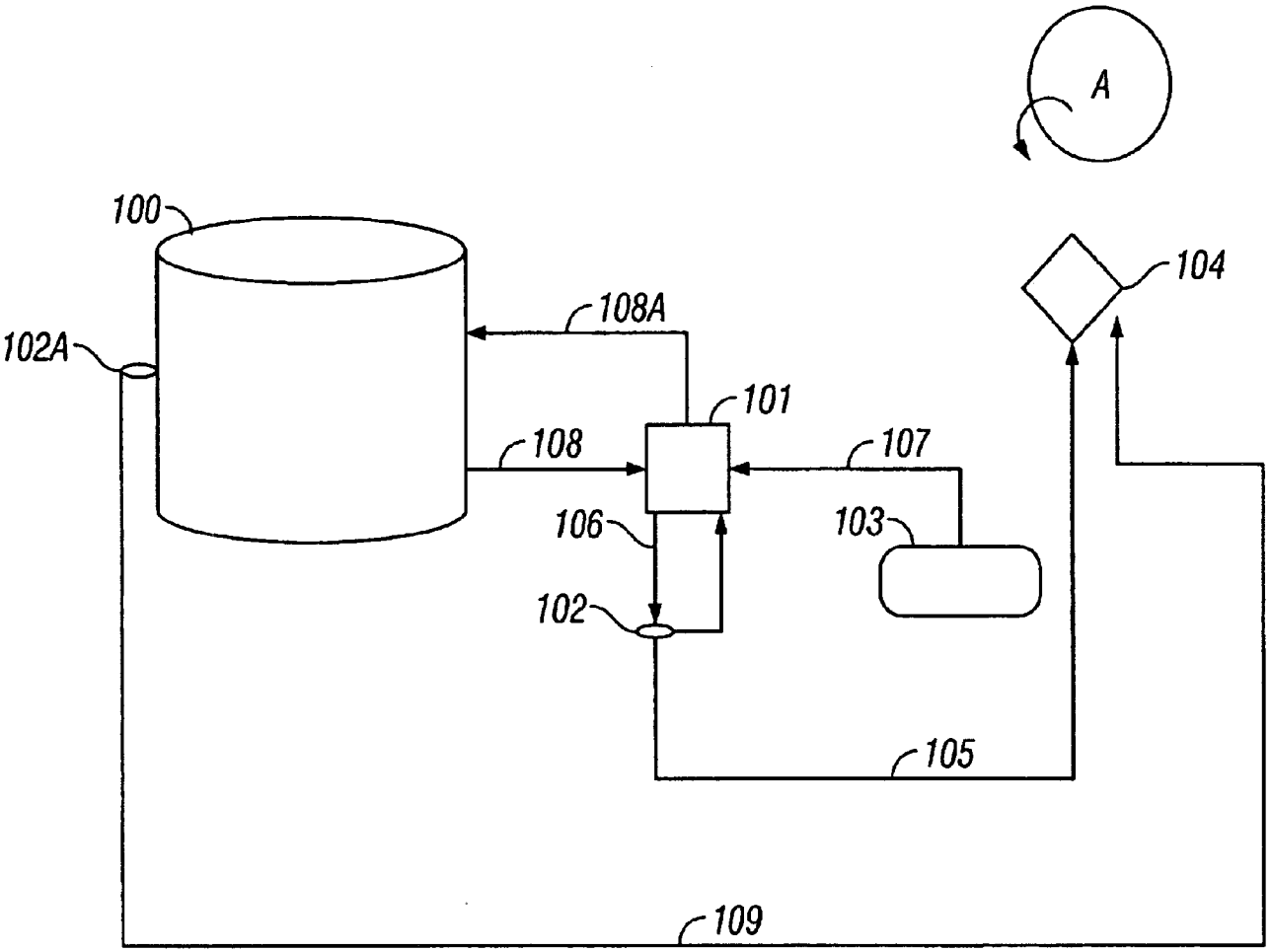
FIG. 1 is a schematic illustration of a storage vessel and a system for determining the storage stability of crude oil or a crude oil admixture stored therein.

In one embodiment, the present invention is a method for storing and transporting crude oil while minimizing the precipitation of asphaltenes. The method may be used at a wellsite, a collection center, a pipeline, a refinery, and other places where crude oil or other complex mixtures containing asphaltenes are produced, transported, stored or used.

In the practice of the method of the present invention, a first value representing the content of unprecipitated asphaltenes in a crude oil or crude oil admixture is preferably made by a first direct measurement of the relative concentration of asphaltenes in a crude oil or crude oil admixture. The first value is compared with the value of a second determination, also preferably by a direct measurement, which is second in time relative to the first measurement. The purposes of making these determinations is to determine whether there is a difference between the two determinations. If there is no difference or if the difference is small and within a predetermined range, then it can be concluded that the asphaltenes present in the crude oil or crude oil admixture are stable.

If the difference in measurements is outside the predetermined range, it indicates that an undesirable amount of asphaltenes will likely precipitate and become held up somewhere in pipeline, transportation or storage facility as the case may be. Asphaltenes are known to stick to different surfaces after they precipitate out of crude oil. In this case, remedial steps are taken in order to control, prevent, inhibit or otherwise mitigate the precipitation of asphaltenes during storage or transportation. The steps taken are according to the nature and quantity of the difference. In most cases, additional chemicals are required to reduce or eliminate precipitation of asphaltenes out of the crude oil.

During the time between the two direct measurements, the crude oil or crude oil admixtures are held at a standard temperature or temperatures and for a standard period. The other properties of the crude oil are also preferably standard, such properties including agitation or non-agitation, padded or non-padded storage, pad gas selection, pressure, and the like. For the purposes of the present invention, the standard properties are collectively called standard conditions. Preferably, the standard conditions include the standard properties of temperature or temperature profile. More preferably, the standard conditions also include agitation or non-agitation. Most preferably, the standard conditions include all variables that could influence precipitation of asphaltenes from crude oil or crude oil admixtures.

While the standard conditions of the method of the present will necessarily vary with the crude oils being handled and equipment and conditions used to handle the crudes, preferably, the standard conditions will selected to allow for a determination of the stability of the crude in as brief a time as possible. For example, if a crude oil is going to spend week in transit through a pipeline, it is preferably not necessary to observe the crude oil for a week to determine if it will be stable under the conditions existent in pipeline. By carefully selecting a standard temperature which is lower or higher than the pipeline shipping temperature, for example, a test made in three days under these stress conditions could predict the stability of the crude for more than a week at pipeline conditions.

Many different chemical, physical and spectroscopic ways of detecting and determining the concentrations of asphaltenes in a complex mixture such as oil are utilized in the laboratory. Real-time or substantially real-time, on-site, asphaltene determinations are preferred for the practice of the present invention. For purposes of the present invention, on-site means in close proximity to the asphaltene containing crude oil being transported or stored.

While any method known to those of ordinary skill in the art of making such determinations can be used with the present invention, it is preferred to use a fiber optic attenuated total reflection probe and an ultraviolet/visible spectrometer to directly determine the amounts of asphaltenes in a crude oil or crude oil admixture by measuring the absorbances in a wavelength range of about 200 nm to about 2,000 nm and then transmit the results to a data gathering and processing circuit or unit such as a microprocessor based unit or a computer for data analysis. For the purposes of the present invention, the term ATR means an attenuated total reflectance device including an attenuated total reflectance probe and a means of measuring the absorbance of a material in contact with the probe.

An ATR is preferred for the practice of the method of the present invention because it permits both in-laboratory measurements and real-time direct measurements of the absorbance of crude oil containing asphaltenes which is normally opaque and dark. ATR probes useful with the present invention can be placed at different locations to collect the asphaltene-concentration data, including, but not limited to: a pipeline, a storage tank, a transfer line, a sample loop on a recycle pump, and other such locations. The ATR probes useful with the present invention can also be used as stand alone devices when used in a laboratory with crude oil blend models.

The readings of the absorbance spectra of a typical crude oil, are made at a wavelength ranging from about 200 nm to about 2,000 nm, generally known as the ultraviolet or UV, visible or VIS, and near infrared or NIR spectral regions. For the present invention, a preferred wavelength range is from about 220 nm to about 1,000 nm. More preferably, the wavelength range is from about 220 nm to about 800 nm, and most preferably from about 220 nm to about 400 nm.

In the practice of the present invention, a crude oil sample is analyzed with an ATR wherein a beam of light, a form of electromagnetic wave, from a source lamp is sent to a sensor with an exposed surface placed in contact with the crude oil in a chamber and the transmitted light is sent back to a filter/detector. With proper connections and the associated instruments and electronics, the signals of a measured absorbance may be transmitted conveniently by using optical fibers to a control unit for spectral data storage, analysis and/or comparisons. The absorbance spectrum obtained by using an ATR is analyzed and compared with the help of suitable computer programs or other processing unit. The probe path length may vary, depending on the wavelength of the light used.

In the practice of the present invention, optionally, a correlation or calibration curve may be established, ex situ, to determine absolute amounts of asphaltenes in the crude oil as a function of the absorbance. Periodic in situ or ex situ calibrations may also be made to determine the accuracy of the measurements as well as the correlations. In addition, the asphaltene measurements may be made with references to air, toluene, xylenes or other suitable materials.

It is important that the ATR probe be selected such that it can be used in the application of the present invention. For example, depending upon the components present in the crude oil being tested, a probe can be exposed to corrosive conditions and high temperatures and/or pressures. The optics of the probe should be such that they will not decompose or become occluded. For example, preferably, the optics of a probe useful with the present invention will be made of sapphire.

The absorbance of asphaltenes in crude oil may be expressed in different ways. It can be determined at a single point data at a selected wavelength, at a plurality of wavelengths within the range disclosed herein, as an entire spectrum between two wavelengths, or any combination thereof. Any method or system of expressing absorbance of asphaltenes in crude oil known to be useful to those of ordinary skill in the art of making such measurements can be used with the present invention.

For practicing the method of the present invention, it is preferred that there are at least two probes for obtaining at least two direct ATR measurement signals. For example, in the case of a system for practicing the methods of the present invention, at least one probe is placed in a sample loop on a circulating pump for a storage tank and a second probe is placed in direct contact with the storage tank contents. There is typically an on-site processor to handle the data. The data obtained from direct ATR measurements of asphaltene contents in the crude oil are collected, analyzed and compared to prior data for the same crude oil. The probe data is processed preferably onsite to determine the asphaltene concentration in the crude oil. While not a preferred embodiment of the present invention, the first determination of a value representing the content of unprecipitated asphaltenes in a crude oil admixture can be an mass-average determination on the separate components prior to the separate components being admixed.

The comparison of relative asphaltene concentrations can be accomplished by using a processor. For a stable crude oil or crude oil admixture, it is expected that there will be little or no change in asphaltene concentration with the passing of time. If the amount of asphaltenes in the crude oil is less than the expected amount, it can be reasonably inferred that some asphaltenes have precipitated and separated out and could cause difficulties during transportation or further storage. Depending on how much of the asphaltenes have precipitated, there may be a need to change or adjust various mitigating, controlling or inhibiting treatments such as increasing the level of additives or changing temperatures. While any precipitation is undesirable, there may be a range within which precipitation can be tolerated.

As discussed hereinabove, there may be a plurality of probes for monitoring the asphaltenes concentrations in the same crude oil. It is also within the embodiment of the present invention to have a plurality of probes monitoring several crude oil or crude oil admixtures at the same time. The measured absorbance and the corresponding signals may be sent to the same or a different data processing unit.

While the preferred embodiment is to compare directly absorbance values, there are other methods that can be used to determine the change in asphaltene concentrations of crude oil and crude oil admixtures. One such method is to use a calculated figure. This figure may be obtained by a theoretical calculation, by extrapolation or interpolation of a calibration curve, and others. In another embodiment, a laboratory analysis of the asphaltenes in the actual crude oil is made and correlated to absorbance. It is also within the embodiment of the present invention to use a previous analysis from the same or a different monitoring system as a reference to determine the difference of asphaltenes concentrations.

As shown above, calculated figures can be used as the values representing asphaltene concentrations for the methods of the present invention, but, preferably a direct comparison is made. Most preferably, a stabilized control is used to determine asphaltene precipitation. In this embodiment, a sample of the crude oil or crude oil mixture to be evaluated is treated with a material to stabilize the asphaltenes and prevent their precipitation. This stabilized crude oil is then used as a control and tested for absorbance in parallel with the material of interest. The advantages of this procedure include the ability to make relative measurements without resort to calibrations and the other procedures necessary to making absolute determinations of asphaltene concentrations.

In the practice of the present inventions, a predetermined range for a change in the relative asphaltene concentration of a crude oil or crude oil admixture over time is used to trigger or not trigger remedial actions to control or mitigate asphaltene precipitation. This predetermined rage can be prescribed in many different ways or even a combination of ways because it depends upon the point at which asphaltenes will precipitate from a crude oil which itself is subject to a number of factors. The factors which affect asphaltene precipitation include the composition of the crude oil, the asphaltene concentration in the particular crude oil, the accuracy of the ATR used, the operating experience of a particular pipeline or storage facility, the effectiveness of a particular treatment for a pipeline or a storage facility, and many other factors.

In one particularly preferred embodiment, the method of the present invention is used to evaluate the shipment of an admixture of two very different crude oils. The advantages of shipping a mixture of crude oils can be significant. For example, the viscosity of crude oil transported through a pipeline can effect the energy required to pump the crude oil through the pipeline, so reducing the viscosity of a viscous crude oil by admixing it with a less viscous crude oil can be desirable. One possible consequence of mixing a viscous crude with a less viscous crude is that the two crudes which may be stable in regard to asphaltenes when separate can precipitate significant amounts of asphaltenes after being admixed. In the practice of the method of the present invention, the two crude oils can be admixed and then monitored to determine if the admixture will be sufficiently stable to allow it to be transported as is or with treatment to mitigate asphaltene precipitation.

One example of a way in which a predetermined range can be set is from an operating experience that certain asphaltene levels found in the crude oil after storage is acceptable, even though it is different from the level first determined. It is also possible to set the predetermined range by setting a relative percentage of change. In other words, the range may have to be changed to reflect addition experience gained during the transportation operations or changes or advancements in treatment methods.

Prediction of the storage stability of crude oil or crude oil mixtures is also an embodiment of the present invention. This can be important, particularly where crude oil is held for extended periods of time, such as at a transfer center. The storage stability of a crude oil can be estimated based upon the rate at which the absorbance of asphaltenes changes with time. For example, a crude oil which shows an immediate decrease in asphaltene concentrations can be considered unstable and treated immediately with additives or heat or other remedial means known to mitigate asphaltenes precipitation. On the other hand, a crude oil which shows only minimal decreases in asphaltene concentrations can be considered stable and held indefinitely. With experience, a correlation between rate of absorbance decline and length of storage stability can be determined and used as a means of determining how best to store particular crude oils.

Because all the steps and measurements of the present invention do not need operator intervention, except for checking the accuracy of the sensors or probes, the present invention can be automated with proper computing devices, such as computers, signal transmitters and receivers, computational programs or software to perform the necessary calculations and data comparisons, and other necessary mechanical devices, which can be controlled non-manually when receiving various electromagnetic, electrical, electronic or mechanical commands, instructions or signals.

While the sensors or probes are used to provide direct real-time measurements of asphaltenes, it is not required or needed that the measurements are made continuously. For the present invention, the sensors or probes may be operated in many different modes, continuous, semi-continuous, intermittent, batch or a combination thereof. Crude oil composition and changes in the composition, operating experience and maintenance requirement are some of the factors that influence the choice of how often the measurements are made. Furthermore, it is also within the scope of the present invention that a different signal may be transmitted to a machine or computer or some other form of data processing unit, i.e., a processor, at a remote location and, in response to the difference observed, a decision of adjusting the output of an apparatus for a particular treatment is sent to that apparatus directly or back to the controller, which then sends a proper command to the apparatus.

While the methods of the present invention can be used to evaluate the stability of crude oil and crude oil admixtures in real time in the actual storage tanks where it is being held, the methods of the present invention are particularly useful for modeling the blending of crude oils. For the purposes of the present invention, a model crude oil blend is one where a much smaller quantity of a crude oil blend, preferably a lab scale quantity, is prepared and tested in order to predict the behavior of a much larger blend. The method of the present invention, when used with models, provides for a quick and cost effective means of determining the stability of crude oil blends.

In one embodiment of the present invention, it is decided to make a blend of a very heavy crude oil with a very light crude oil and several models are run prior to making the actual blend. After running the models, the data from the experiment allows for the selection of an optimum ratio of components which can transported most efficiently. Factors which weigh in this selection can include (a) achieving a desirable viscosity, (b) ensuring an acceptable level of asphaltene precipitation during the transport period, and (c) making a cost effective use of asphaltene stabilizing additives.

In another embodiment of the present invention, it is decided that two or more crude oils are going to be blended at a predetermined ratio prior to transporting the blended crude oils using a pipeline. Several identical samples of the blended crude oil are admixed with varying levels of an asphaltene inhibiting additive and then tested for asphalting precipitation stability. The resulting data is then used to determine the optimum level of asphaltene inhibiting additive to mix with the crude oil blend prior to transporting the crude oil blend through a pipeline.

A step-by-step description of one embodiment in accordance with the present invention is made with reference to FIG. 1. FIG. 1 is a schematic diagram of a system (A) wherein a crude oil admixture is tested for stability prior to being transported. In this system, an admixture of two or more crude oils is pumped into a vessel (100). The contents of the vessel are recirculated (also known as recycled) from the vessel through an intake pipe (108) leading to a pump (101) and back into the vessel (100) through a return pipe (108*a*).

On the pump (101) is a sample loop (106) which includes an ATR and associated electronics (102). The ATR (102) is in contact with the crude oil admixture which is passing through the sample loop (106). A signal representing an asphaltenes absorbance of the crude oil admixture is sent from the ATR by means of a cable (105) to a processor (104).

Once the signal (not shown) reaches the processor (104), software preloaded on the processor compares the signal to a previously stored signal. The previously stored signal is a an absorbance spectra of the crude oil or crude oil admixture which has been stabilized with an additive. Based on the differences between the present signal and the previously stored signal, a decision is made to either transport the stored crude oil admixture or treat it to inhibit asphaltene precipitation. If the decision is to treat the crude oil admixture, an additive is pumped using the recirculating pump (101) from an additive source (103) through a pipe (107) into the crude oil admixture. If the decision is to transport the crude oil or crude oil admixture, the crude oil or crude oil admixture is loaded onto trucks or pumped into pipes or pipelines (not shown) and transported to a refinery or other location for conversion into petroleum products such as gasoline, fuel oil, lubricants, and the like.

In a preferred embodiment, a second probe (102*a*) is present which also communicates to the processor (104) by means of a cable (109). This second probe acts a check on the first probe and can also be used to determine the extent of mixing of the two crude oils.

It is further noted that while a part of the foregoing disclosure is directed to some preferred embodiments of the invention or embodiments depicted in the accompanying drawings, various modifications will be apparent to and appreciated by those skilled in the art. It is intended that all such variations within the scope and spirit of the claims be embraced by the foregoing disclosure.

EXAMPLES

The following examples are provided to illustrate the present invention. The examples are not intended to limit the scope of the present invention and they should not be so interpreted. Amounts are in weight parts or weight percentages unless otherwise indicated.

Example 1

Figure 2:
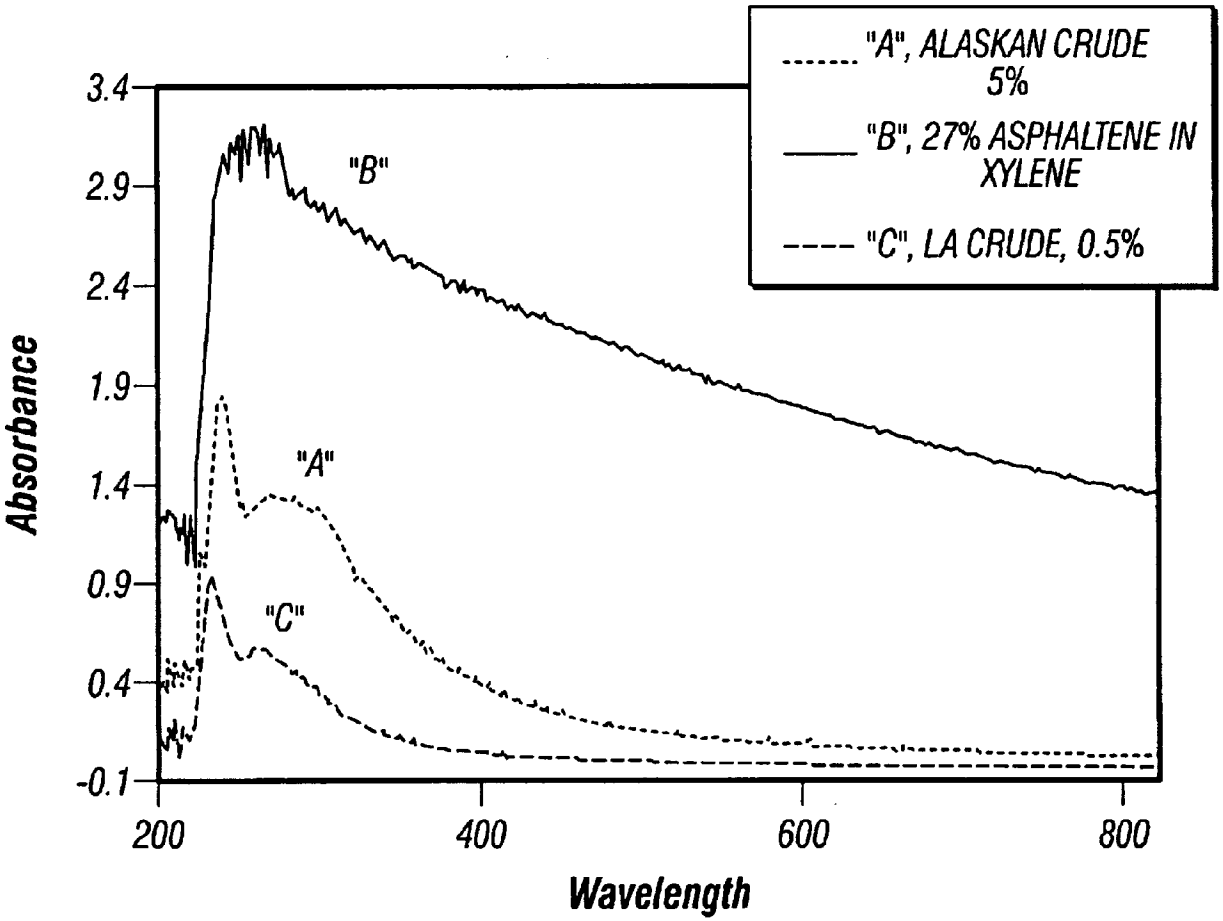
FIG. 2 shows a representative absorbance spectrum corresponding to different amounts of asphaltenes in xylenes.

Laboratory measurements utilizing a UV/visible Spectrophotometer and a fiber-optic ATR probe with air as a reference are used to determine the absorbance as a function of wavelength for different concentrations of asphaltene in crude oil. Spectrum A is obtained with an Alaskan crude with 5 wt % asphaltenes; spectrum B, a synthetic mixture of 2.7 wt % of asphaltenes in xylenes; and spectrum C, a Louisiana crude having about 0.5 wt % asphaltenes. The spectra A-C, FIG. 2, show that there is a monotonic correlation between the asphaltenes concentrations and ATR absorbances in a wavelength range of from about 220 nm to about 400 nm.

Example 2

Figure 3:
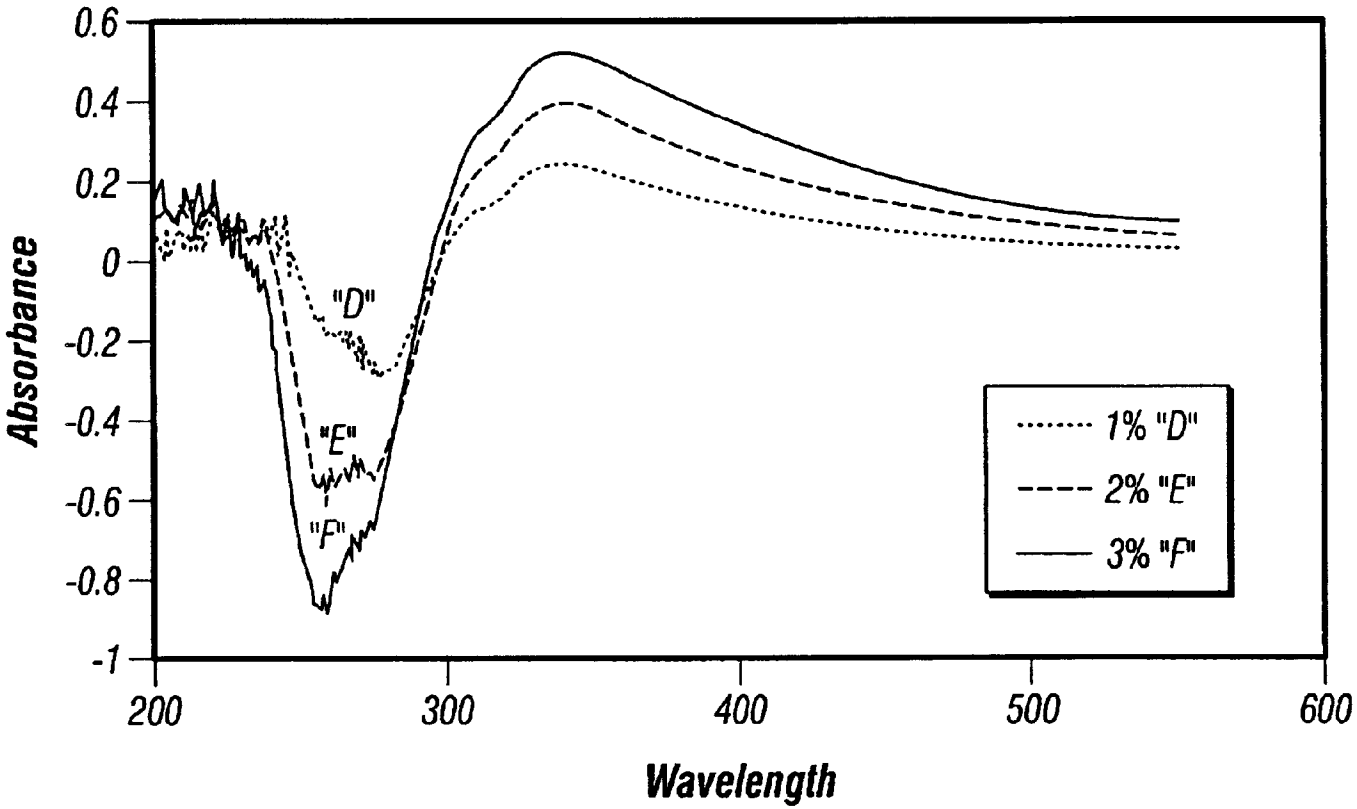
FIG. 3 shows a representative absorbance spectrum of different amount of asphaltenes in toluene.

Example 2 is carried out in a similar manner as Example 1, except that the various samples are measured with toluene as a reference. ATR spectra D, E, and F are obtained with 3 wt %, 2 wt % and 1 wt % of asphaltenes in crude oil respectively. The results are shown in FIG. 3. The spectra in FIG. 3 also show that there is a monotonic correlation between the asphaltenes concentrations and ATR absorbances in a wavelength range of from about 220 nm to about 550 nm. These experiments described above in FIGS. 2 and 3 indicate the suitability of an ATR probe for directly measuring asphaltene concentration in crude oil.

Example 3

Figure 4:
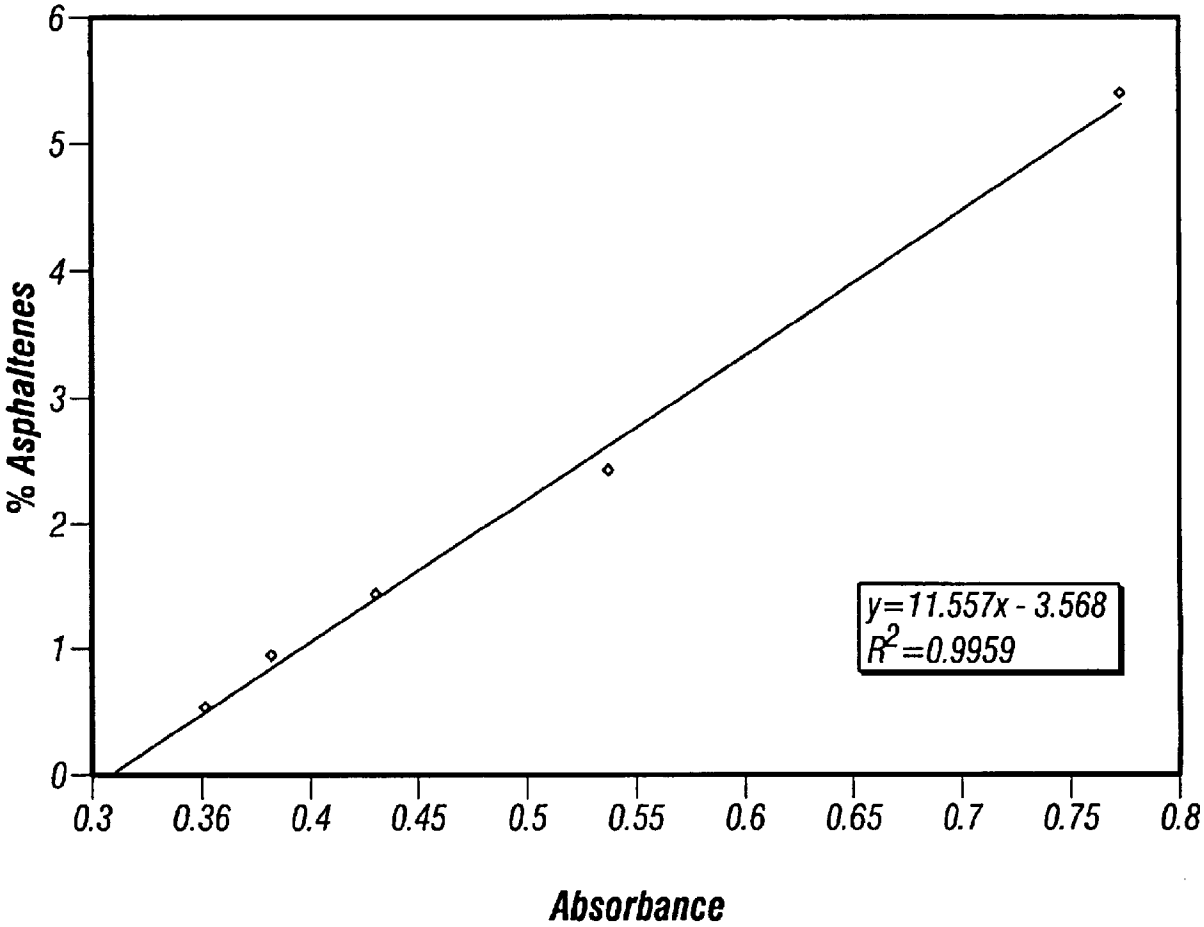
FIG. 4 represents a typical correlation of the absorbance measured with asphaltenes contents by weight.

Asphaltenes are extracted from a crude sample by precipitation with heptane. The extracted asphaltenes are added to a crude oil sample and the absorbance measured with the probe at 233 nm. The crude originally contained 0.44% asphaltenes. The resulting plot of % asphaltenes vs. absorbance yields a linear correlation with an $R^2$=0.9959. The results are displayed below in Table 1 and in graphical form in FIG. 4.

TABLE 1

| Absorbance @ 233 nm | Total % Asphaltenes of Sample |
|---|---|
| 0.3529 | 0.54 |
| 0.3833 | 0.94 |
| 0.4312 | 1.44 |
| 0.5389 | 2.44 |
| 0.7719 | 5.44 |

Example 4

Figure 5:
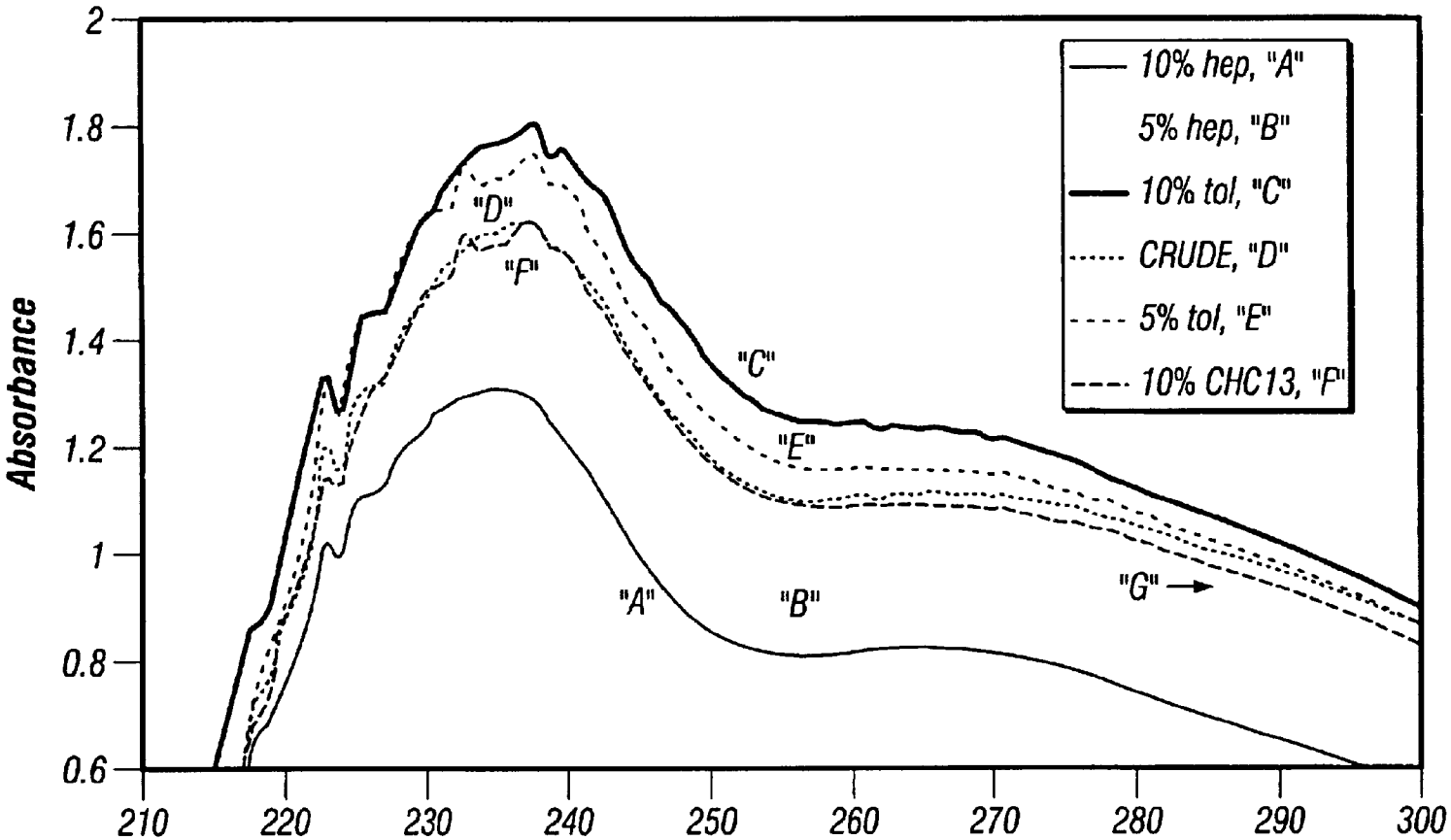
FIG. 5 represents the effects of certain solvents on the relative asphaltene concentration of a crude oil sample and the resultant changes in the sample's UV absorbance spectra.

Three solvents; chloroform, toluene, and heptane; are selected to be added to a sample of crude oil. Chloroform has no effect on asphaltenes in crude oil. Toluene dissolves asphaltenes. Heptane precipitates asphaltenes from crude oil. The UV absorbance of the crude oil sample is measured, 5 and 10 percent chloroform are added to the sample and the absorbance measured again with very little change in absorbance. 5 and 10 percent toluene are added to a sample of the same crude oil. Absorbance measurements increase, indicating an increase in dissolved asphaltene content. 5 and 10 percent heptane are added to a sample of the same crude oil. The absorbance decreases, indicating a decrease in the amount of dissolved asphaltene content of the sample. The results are displayed below in Table 2 and graphically in FIG. 5.

TABLE 2

| Sample | Probe Reading (Absorbance @ 233 nm) | Probe Reading (Absorbance @ 254 nm) |
|---|---|---|
| Crude + 10% toluene | 1.769 | 1.274 |
| Crude + 5% toluene | 1.707 | 1.185 |
| Crude (neat) | 1.605 | 1.113 |
| Crude + 5% chloroform | 1.612 | 1.154 |
| Crude + 10% chloroform | 1.584 | 1.107 |
| Crude + 5% heptane | 1.469 | 0.9687 |
| Crude + 10% heptane | 1.312 | 0.8170 |

Example 5

Figure 6:
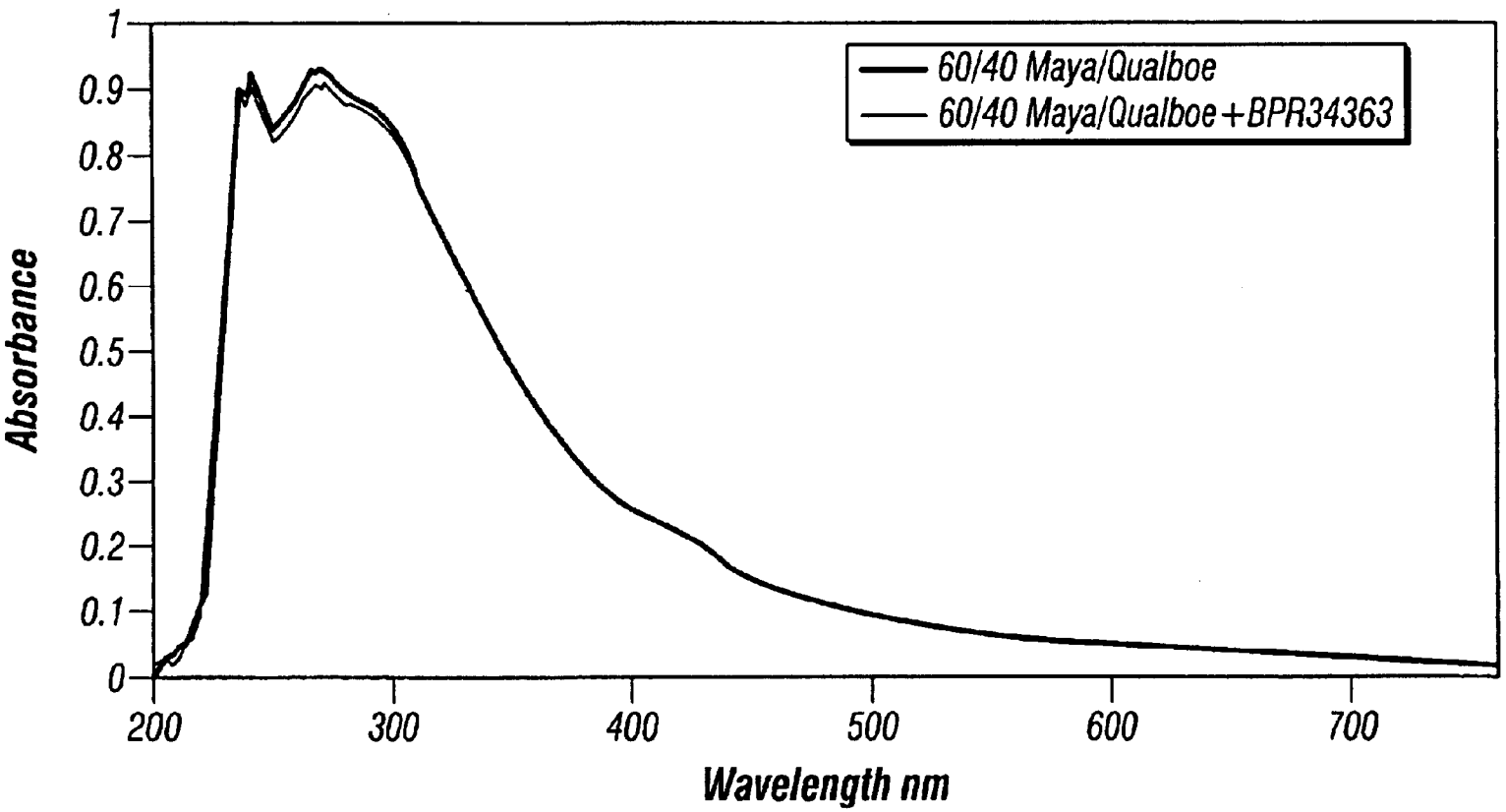
FIG. 6 shows the first overlay of representative absorbance spectra of a crude oil blend and the same crude oil blend treated with a material that inhibits the precipitation of asphaltenes.

A mixture of two crude oils, 60 percent Maya and 40 percent Qualboe is prepared. A portion of the admixture is treated with an asphaltene precipitation abatement additive, BPR34363, which is used as a control reference. The absorbance over the spectrum ranging from 200 nm to 760 nm is measured for both materials and the scans are overlaid as shown in FIG. 6.

Figure 7:
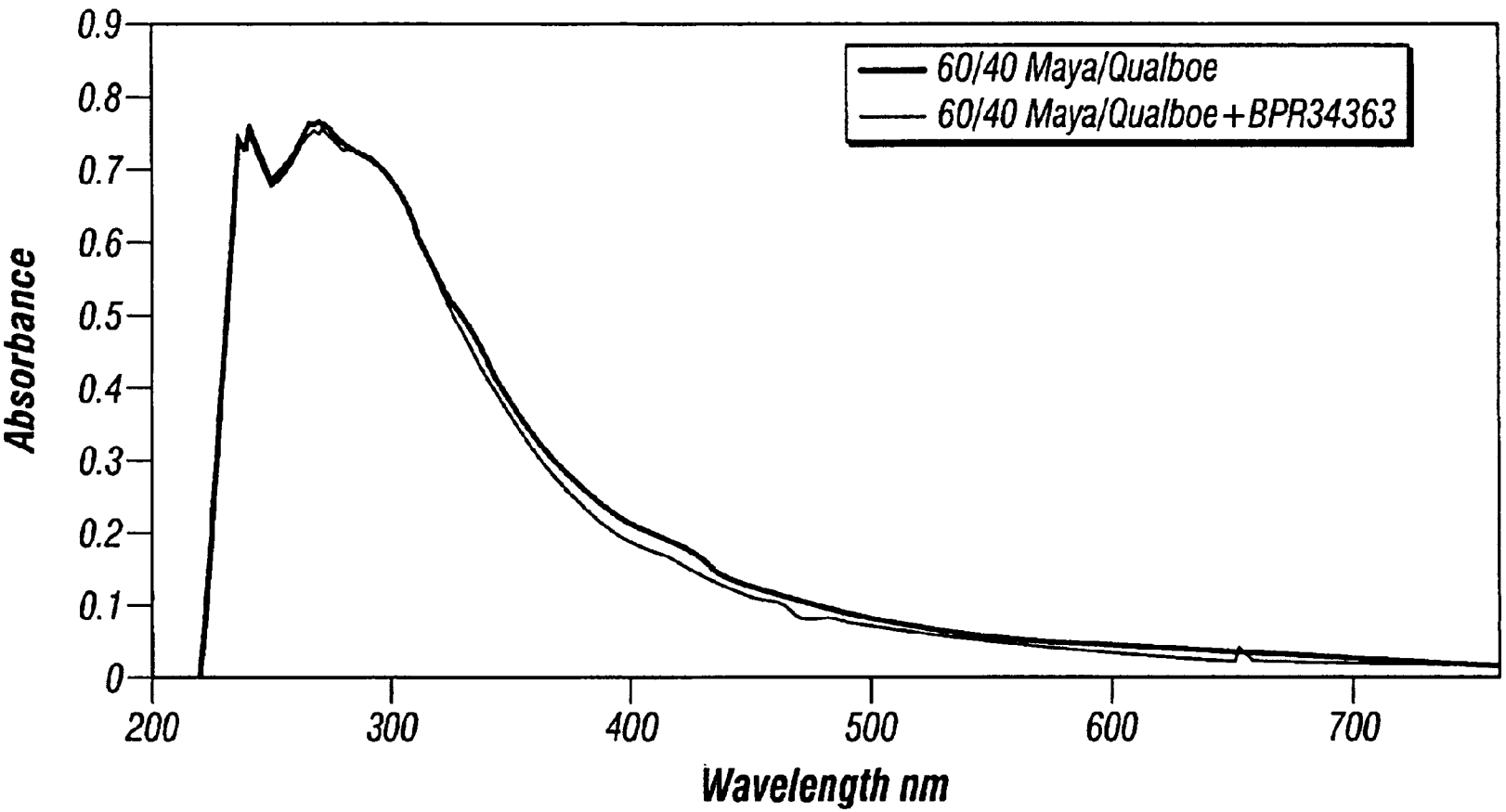
FIG. 7 shows the second overlay of representative absorbance spectra of a crude oil blend and the same crude oil blend treated with a material that inhibits the precipitation of asphaltenes after being held at 100° C. for two days.
Figure 8:
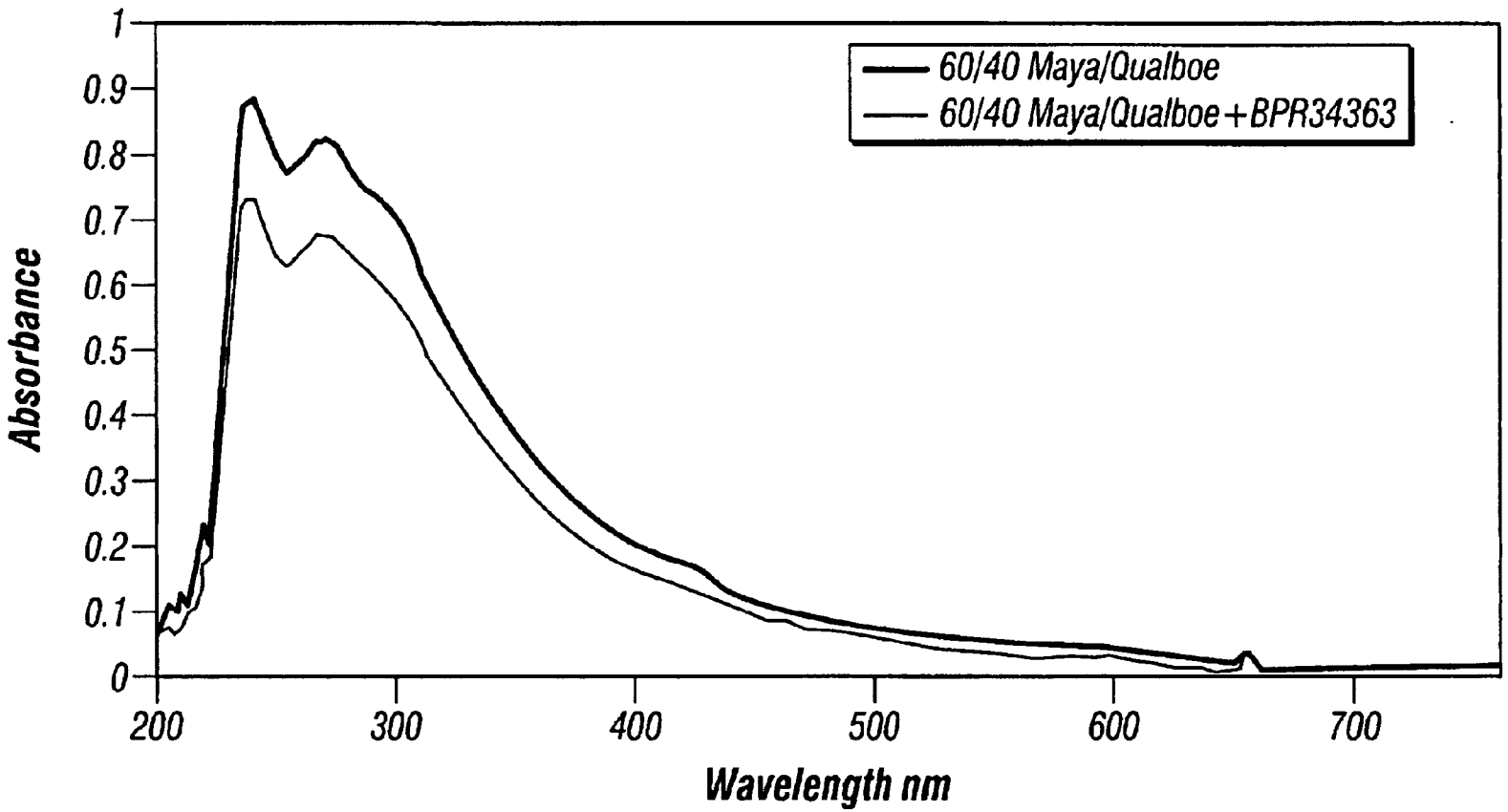
FIG. 8 shows the third overlay of representative absorbance spectra of a crude oil blend and the same crude oil blend treated with a material that inhibits the precipitation of asphaltenes after being held at 100° C. for three days.
Figure 9:
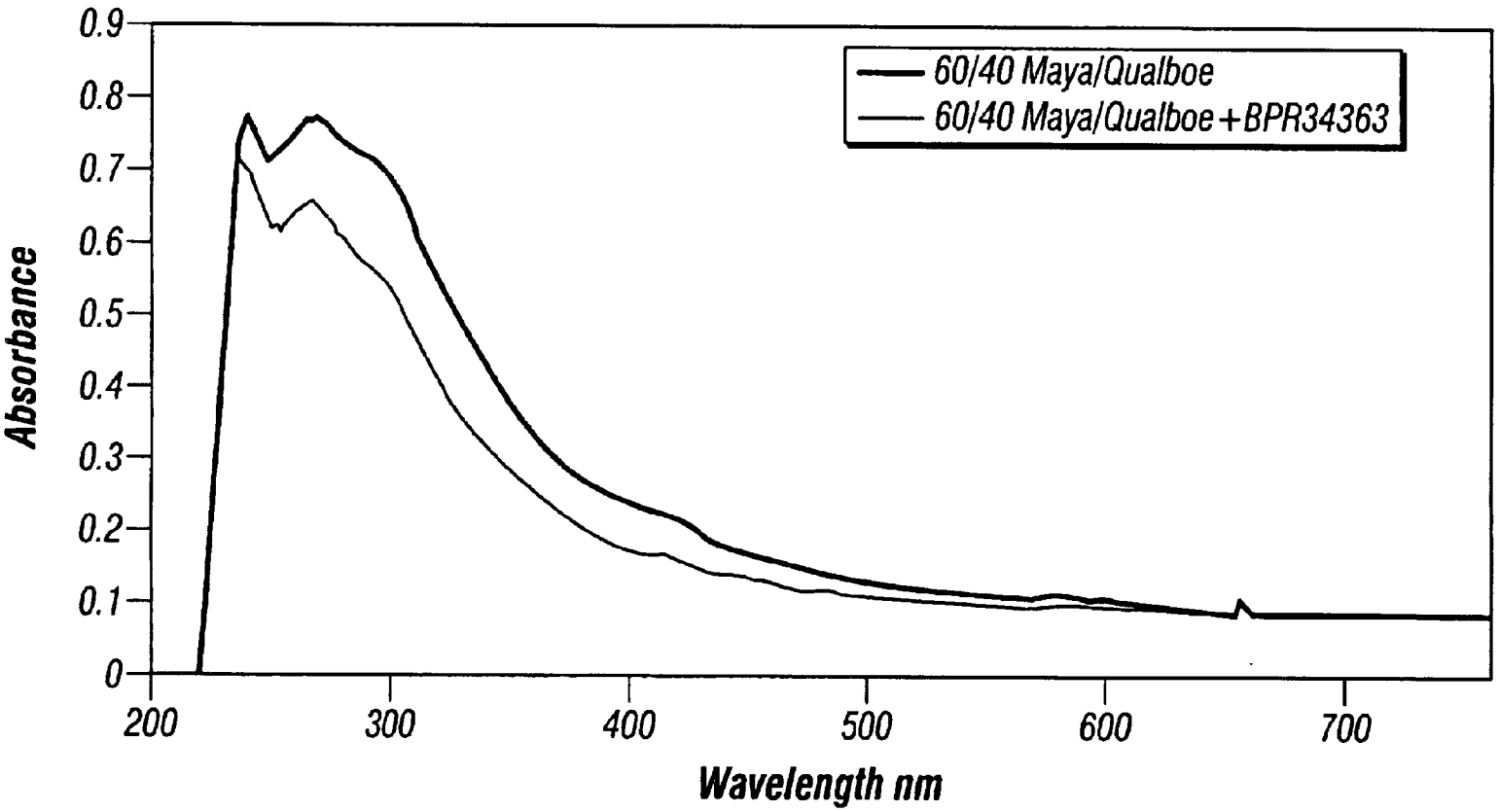
FIG. 9 shows the fourth overlay of representative absorbance spectra of a crude oil blend and the same crude oil blend treated with a material that inhibits the precipitation of asphaltenes after being held at 100° C. for one week.

The two materials are held at 100° C. for one week with additional absorbance scans made as on day one on day two, day three and at one week. These overlay scans and shown in FIGS. 7, 8, and 9 respectively.

As can be seen, the scans at day one and day two are nearly identical, but on day 3, there is a significant divergence with the untreated crude oil admixture showing a substantial decrease in absorbance. This indicates that there has been a precipitation of asphaltenes which could mean that the untreated sample could not be safely transported.

What is claimed is:

1. A method for transporting blended crude oils comprising the steps of;

(a) admixing a first crude oil with a second, different crude oil to form a crude oil admixture;

(b) determining a first value representing the content of unprecipitated asphaltenes in the admixture; (c) holding the admixture for a period of time at standard conditions;

(d) determining a second value representing the content of unprecipitated asphaltenes in the admixture; and (e) taking remedial action to prevent asphaltene precipitation prior to transporting the admixture if the second value is outside a predetermined range from the first value, wherein the determining of a first or second value representing the content of unprecipitated asphaltenes in the admixture is done using a sensor that is a fiber optic attenuated total reflectance probe.

2. The method of claim 1 wherein the admixture is transported through a pipeline, pipes or in tanks.

3. The method of claim 1 wherein a processor makes real time relative concentration determinations of asphaltenes in the admixture.

4. The method of claim 3 wherein the fiber optic attenuated total reflectance probe has an exposed surface in contact with the admixture.

5. The method of claim 4 wherein the processor determines absorbance from the sensor data as a function of wavelength.

6. The method of claim 1 wherein the remedial actions include the addition of an additive, which prevents or mitigates the precipitation of asphaltenes, to the admixture.

7. The method of claim 4 wherein the data from a fiber optic attenuated total reflectance probe is UV absorbance data.

8. The method of claim 7 wherein the UV absorbance data is absorbance in the range of from about 220 nm to about 800 nm.

9. The method of claim 8 wherein the UV absorbance data is absorbance in the range of from about 220 nm to about 400 nm.

10. The method of claim 1 wherein steps (a), (b), (c) and (d) are performed using a model crude oil blend.

11. The method of claim 10 wherein step (e) further comprises making a large scale blend based upon the model crude oil blend prior to taking remedial action.

* * * * *